US005835606A

United States Patent [19]

Marie et al.

[11] Patent Number: 5,835,606

[45] Date of Patent: Nov. 10, 1998

[54] HEARING AID WITH INTEGRATED RETRIEVAL LINE AND VOLUME CONTROL

[75] Inventors: Michael J. Marie, Cherry Hill; Sunil Chojar, Lebanon, both of N.J.

[73] Assignee: Siemens Hearing Instruments, Inc., Piscataway, N.J.

[21] Appl. No.: 329,585

[22] Filed: Oct. 26, 1994

[51] Int. Cl.[6] ..... H04R 25/00

[52] U.S. Cl. ..... 381/68.6; 381/69

[58] Field of Search ..... 381/68.6, 68, 68.5, 381/68.7, 68.2, 68.4, 68.3, 69, 69.2, 69.1, 23.1; 181/129, 130, 135

[56] References Cited

U.S. PATENT DOCUMENTS

| | | | |
|---|---|---|---|
| 4,520,236 | 5/1985 | Gauthier | 179/107 |
| 4,830,139 | 5/1989 | Cirillo et al. | 181/130 |
| 5,365,593 | 11/1994 | Greenwood et al. | 381/68.6 |

FOREIGN PATENT DOCUMENTS

| | | |
|---|---|---|
| 0 517 323 B1 | 6/1995 | European Pat. Off. . |
| 2 634 645 | of 1990 | France . |
| 3719830 A1 | 12/1987 | Germany . |
| 41 07 861 A1 | 9/1991 | Germany . |
| 92 13 343 U | 3/1993 | Germany . |
| 9407070.9 | 8/1994 | Germany . |

OTHER PUBLICATIONS

Hearing Instruments, vol. 44, No. 12, pp. 26–27 (1993), "Exploring the Deep Canal Fitting Advantage", Vass et al.

The Hearing Journal, vol. 47, No. 11, pp. 29–35 (Nov., 1994), CIC Hearing Aids: What Is Their Impact On The. . . , Mueller.

The definition of the "cable" in the Webster's New Collegiate Dictionary, 1977.

*Primary Examiner*—Huyen Le

*Attorney, Agent, or Firm*—Mark H. Jay

[57] ABSTRACT

A line is secured to the rotor of a potentiometer which serves as the volume control for a Completely In the Canal ("CIC") hearing aid. The patient can change the volume of the aid by rotating the line and can remove the aid from the ear canal by pulling on the line. By mounting the line on the potentiometer, more space is freed up on and in the hearing aid housing and the patient can change the volume without removing the aid from the ear canal.

2 Claims, 2 Drawing Sheets

HEARING AID WITH INTEGRATED RETRIEVAL LINE AND VOLUME CONTROL

BACKGROUND OF THE INVENTION

The invention relates to hearing aids, and more specifically relates to small hearing aids. In its most immediate sense, the invention relates to CIC aids, i.e. hearing aids which are worn Completely In the Canal of the user's ear.

CIC aids are tiny aids that are worn deep within the patient's ear so as to be not only inconspicuous but indeed almost invisible. Like all hearing aids, a CIC aid must be serviced (cleaned, battery changed) at intervals, and such servicing requires that the aid be removed from the patient's ear. This operation is uniquely difficult for CIC aids, because a CIC aid is worn deep in the user's ear and the patient's fingers are too large to reach it.

To overcome this difficulty, CIC aids are conventionally sold with retrieval lines. A retrieval line is a thin filament of e.g. skin-colored plastic which is fixed to the hearing aid housing and which is sufficiently long to extend out of the patient's ear canal. A retrieval line may be enlarged at its distal end to make it more easily graspable.

CIC aids, like other hearing aids are conventionally equipped with potentiometers connected as volume controls. The patient adjusts the volume control to suit his or her preference. However, the CIC aid must be removed from the ear to adjust the volume control, and this is bothersome. Moreover, the volume control on a CIC aid is exceedingly small and must be adjusted using a small screwdriver. This difficulty is most often exacerbated because hearing aid patients tend to be elderly and to have arthritis problems which limit their dexterity.

Circuit designs for use in CIC aids are severely constrained by lack of space, or "real estate", inside and on the surface of the hearing aid housing. This is caused not only because the CIC aid is tiny to begin with, but also because the retrieval line and the volume control on a CIC aid take up real estate on the microphone side of the aid.

It would be advantageous to provide a CIC hearing aid wherein the volume control could be more easily and conveniently adjusted and wherein more space was available for electrical circuit components.

In accordance with the invention, a hearing aid has a housing which contains a hearing aid circuit. The housing also contains a potentiometer which is connected to serve as a volume control. The potentiometer has a rotor which is rotated to adjust the volume, and a flexible line is fixed to the rotor. The cable projects out of the housing and out of the ear canal in such a manner that a patient can grasp the line.

In accordance with the invention, the patient can adjust the volume of the aid by rotating the line. It is therefore unnecessary to remove the aid from the ear and to struggle with a tiny potentiometer. In further accordance with the invention, the retrieval line is attached to the potentiometer, thereby eliminating the extra space required when the retrieval line is located elsewhere.

Advantageously, the distal end of the line is enlarged. This makes it easier for an arthritic and nondexterous patient to grasp the end of the line.

BRIEF DESCRIPTION OF THE DRAWINGS

The invention will be better understood with reference to the following illustrative and non-limiting drawings, in which.

DETAILED DESCRIPTION OF A PREFERRED EMBODIMENT

Figure 1:
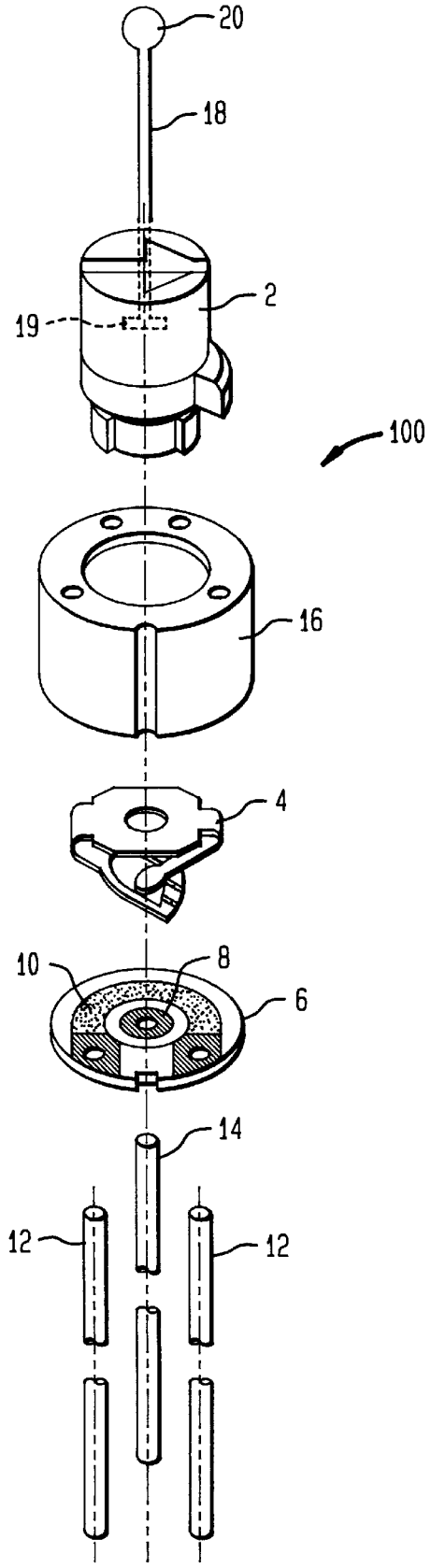
FIG. 1 is an exploded view of a portion of the preferred embodiment of the invention.

FIG. 1 shows a potentiometer generally indicated by reference number 100 of the type manufactured by the firm of Resistance Technologies, Inc. of Arden Hills Minn. under the Model 37 designation. (The invention does not reside in the particular manufacturer and model number utilized; other products can be used instead.) The potentiometer 100 has a rotor body 2, which is fixed to a contact wiper 4. The contact wiper 4 makes electrical contact with a resistive plate 6, which has a central region 8 and a circumferential region 10. Leads 12 are connected to the ends of the circumferential region 10 and lead 14 is connected to the central region 8. A housing 16 holds the potentiometer 100 together.

In use, one part of the contact wiper 4 makes electrical contact with the central region 8 and another part of the contact wiper makes contact with the circumferential region 10. This forms a conventional potentiometer 100, wherein the leads 12 are connected to the ends of the potentiometer 100 and the lead 14 is connected to the wiper of the potentiometer 100.

In accordance with the invention, an elongated flexible line 18 of e.g. flesh-colored plastic is fixed (as by anchoring using anchor 19) to the rotor body 2. Alternatively, the line 18 may be adhesively secured to the rotor body 2 or may be molded integrally with it. In accordance with the preferred embodiment, the distal end 20 of the line 18 is enlarged so it can be easily grasped by an elderly and arthritic patient.

The referenced potentiometer 100 and line 18 are mounted in a CIC hearing aid housing 22. The leads 12 and 14, and therefore the potentiometer 100, are connected to a hearing aid circuit 24 in such a manner that the potentiometer 100 serves as a volume control.

In use, the distal end 20 of the line 18 projects out of the patient's ear canal (not shown), to a position where the distal end 20 can be reached and grasped by a patient's fingers (not shown). When the patient wishes to change the volume setting, the line 18 is rotated about its axis. (The line 18 is sufficiently stiff so that rotation of the distal end 20 will cause rotation of the rotor body 2.) When the housing 22 is to be removed from the ear canal, the patient grasps the distal end 20 and pulls the housing 22 out of the ear.

Figure 2:
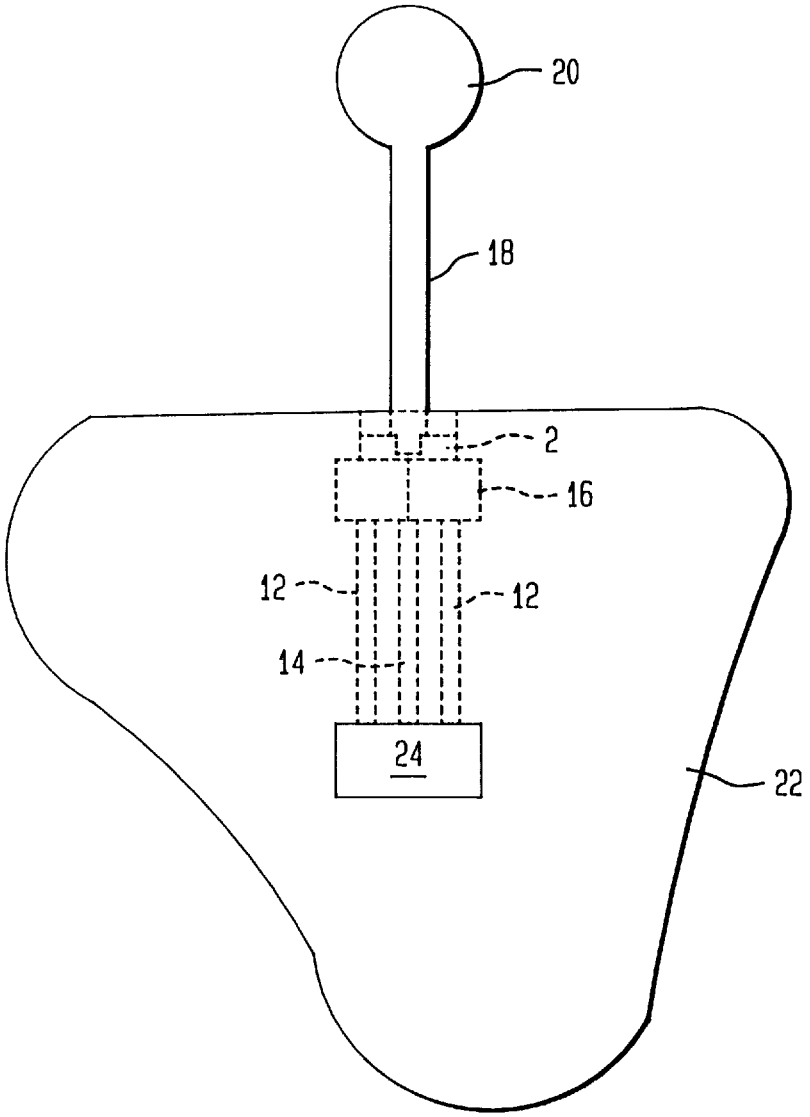
FIG. 2 is a side view of the preferred embodiment of the invention.

It will be understood that the housing 22 is custom-molded to fit the patient's ear canal and that the illustration in FIG. 2 is only exemplary. The several parts of the preferred embodiment have been selectively enlarged and simplified for clarity, and the Figures are not to scale.

Although a preferred embodiment has been described above, the scope of the invention is limited only by the following claims:

We claim:

1. A completely-in-canal (CIC) hearing aid, comprising:

a CIC housing containing a hearing aid circuit;

a potentiometer contained in the housing and connected to said circuit in such a manner as to operate as a volume control therefor, the potentiometer having a rotatable rotor; and an elongated flexible line fixed to said rotor in such a position as to rotate the rotor when the line itself is rotated, the line extending out of an opening in said housing in such a manner that a patient wearing the hearing aid completely within an ear canal can grasp the line, can adjust hearing aid volume by rotating the line and can pull the hearing aid out of the ear by pulling on the line.

2. The hearing aid of claim 1, wherein the line has a proximal end which is secured to the rotor and a distal end which is remote from the proximal end, and wherein said line has an enlarged region at said distal end.

* * * * *